United States Patent [19]

Kawano et al.

[11] 4,188,713

[45] Feb. 19, 1980

[54] METHOD OF MAKING A COMMUTATOR FOR SMALL-SIZED ELECTRIC MOTOR

[75] Inventors: Masatoshi Kawano, Katano; Tsutomu Hashimoto, Shijonawate; Hiroshi Maeda, Hirakata; Miyuki Furuya, Neyagawa, all of Japan

[73] Assignee: Matsushita Electric Industrial Co., Ltd., Kadoma, Japan

[21] Appl. No.: 855,001

[22] Filed: Nov. 23, 1977

[30] Foreign Application Priority Data

Dec. 14, 1976 [JP] Japan ..... 51-167997

[51] Int. Cl.[2] ..... H01R 43/08

[52] U.S. Cl. ..... 29/597; 310/43; 310/235; 310/236

[58] Field of Search ..... 29/597; 310/235, 236, 310/43

[56] References Cited

U.S. PATENT DOCUMENTS

| | | | |
|---|---|---|---|
| 3,662,240 | 5/1972 | Yukisada et al. | 318/325 |
| 3,717,928 | 2/1973 | Yamaguchi | 29/597 |
| 3,812,572 | 5/1974 | Yamaguchi | 29/597 |

*Primary Examiner*—Carl E. Hall

*Attorney, Agent, or Firm*—Cushman, Darby & Cushman

[57] ABSTRACT

A metal tube with outwardly bent risers for terminals is filled with a body of plastic resin which hardens in place. Then the tube is cut through, chordwise, a plurality of times to provide a plurality of segments. An extended, base portion of the plastic resin body through which the risers extend radially outwardly continues to hold the cylindrical disposition of the metal segments, with gaps maintained therebetween. A shaft is fitted coaxially in the base portion of the plastic resin body and extends through a larger diameter central bore of the body, centrally of the commutator segments. The gaps communicate with the annular space between this bore and the shaft, for cleaning out of particulate debris by centrifugal force.

3 Claims, 4 Drawing Figures

METHOD OF MAKING A COMMUTATOR FOR SMALL-SIZED ELECTRIC MOTOR

FIELD OF THE INVENTION

This invention relates to a commutator for a small-sized, e.g. fractional horsepower electric motor and particularly concerns one with a novel construction, improved and suitable for mass production.

BACKGROUND OF THE INVENTION

One typical example of a conventional commutator of a small-sized motor, for example, a fractional horsepower D.C. motor is shown in FIG. 3, which is a plan view thereof and FIG. 4, which is a perspective view thereof. As shown by FIG. 3 and FIG. 4 the conventional commutator is made by filling a metal pipe 1, provided with a specified number of risers 1*a*, with a body of plastic resin 2, which is molded and sets in place in the inside space of the metal pipe 1 and embraces the bases of the risers therein, then cutting shallow slots 3, which extend radially from and include the axis of the metal pipe 1, so that the metal pipe 1 is divided into a specified multiplicity of metal segments. In order to mechanically combine and hold the segments of the commutator in one rigid body, the center core portion 201 of the resin body 2 is retained uncut. Particularly, the slots are cut by advancing a cutting saw radially inwards by a specified small distance, into the resin body 2, toward the axis X of the metal pipe 1, in a manner to retain the central core part 20, uncut. Therefore, in the making of the conventional-type commutator, it is necessary to advance the saw or the like means and cut a slot 3 once each minus one total for the number of segments required. Thus, a considerable number of cuts, taking great care not to cut to an excessive depth are necessary. Furthermore, since a considerable number of the cuttings from generatrices on the slippery metal pipe face into the resin core are necessary, it is not easy to divide the metal pipe 1 into the segments with precise dividing angles around the axis. Besides, since each slot has a shallow bottom, metal powder dust of the commutator segment metal and/or brushes produced during the operation of the rotor incorporating the conventional commutator is likely to be filled and deposited in the slots, thereby causing short-circuiting of the segments.

Neither the metal nor the plastic resin used to make the commutator need depart from that used in the prior art. Typical uses for the commutator are such as those disclosed in the prior U.S. patent of Yokisada et al, U.S. Pat. No. 3,662,240 issued May 9, 1972.

SUMMARY OF THE INVENTION

The present invention provides a commutator for small sized motor, which is designed to be suitable for mass production and is advantageous in that metal powder of the commutator segment metal and/or dust of commutator brushes is flushed from the slots by airflow through the slots.

A metal tube with outwardly bent risers for terminals is filled with a body of plastic resin which hardens in place. Then the tube is cut through, chordwise, a plurality of times to provide a plurality of segments. An extended, base portion of the plastic resin body through which the risers extend radially outwardly continues to hold the cylindrical disposition of the metal segments, with gaps maintained therebetween. A shaft is fitted coaxially in the base portion of the plastic resin body and extends through a larger diameter central bore of the body, centrally of the commutator segments. The gaps communicate with the annular space between this bore and the shaft, for cleaning out of particulate debris by centrifugal force.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
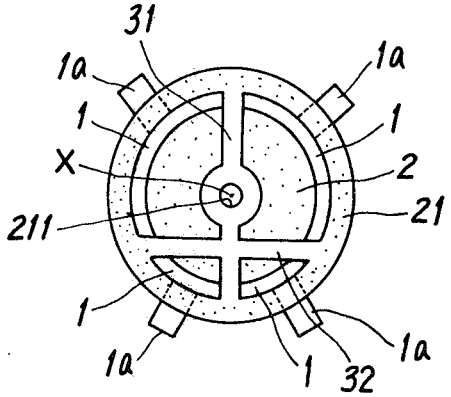
FIG. 1 is a plan view of one example of a commutator embodying the present invention.
Figure 2:
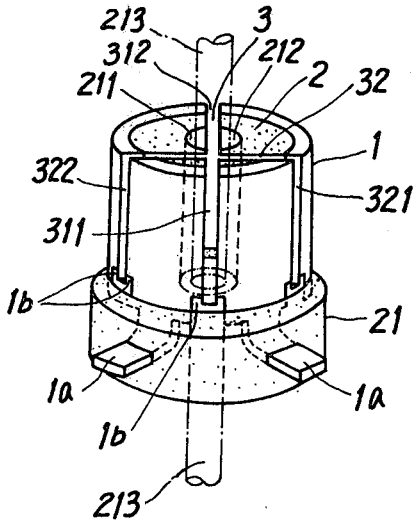
FIG. 2 is a perspective view of the commutator of FIG. 1.
Figure 3:
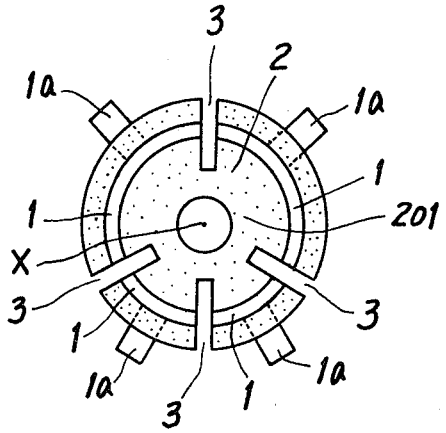
FIG. 3. (Prior Art)
FIG. 3 is a plan view of the above-mentioned one example of a commutator of the prior art.
Figure 4:
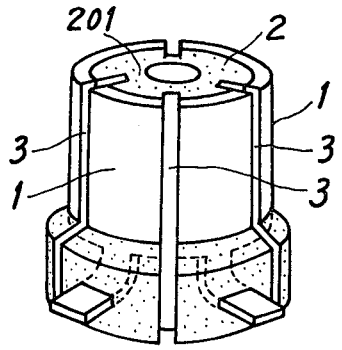
FIG. 4. (Prior Art)
FIG. 4 is a perspective view of the prior art commutator of FIG. 3.

As shown in FIG. 1 and FIG. 2, the construction of a preferred example of the present invention is as follows: The commutator segments are disposed cylindrically around the axis X. The commutator segments 1 comprise risers therein, and notches 1*b* therebetween at its lower end.

The commutator segments 1 are made into a united body by means of a body of hardened plastic 2, which is filled into the space centrally of the cylindrically disposed segments and embeds the bases of the risers and adjacent lower end parts of the segments 1 therein.

The resin body 2 has an axially central through-bore 211 for fitting on a rotor shaft and a base portion 21 of larger outer diameter than the portion which fills the central space among the segments. The through-bore 211 has a diameter so small as to tightly fit and be secured on the shaft 213 in the base portion 21, but has a larger diameter in the commutator portion, so that a thin annular, tubular space 212 is formed around the shaft 213 within the commutator portion. In the base portion the bases of the riser portions 1*a*, and the adjacent lower end parts of the segments are embedded in the plastic when it hardens and thus are supported. Each segment 1 has two notches 1*b*, one at each side of the lower end part thereof. A first deep slot 31 is formed chordwise along a first longitudinal plane including the axis of the commutator, creating an opposing pair of commutator segment gaps 311 and 312 and in a manner that both ends of the lower extent of the deep slot 31 reach the notches 1*b* of the segments 1 which form the gaps 311 and 312 therebetween. A second deep slot 32 is formed chordwise along a second longitudinal plane parallel with the axis x, creating another pair of commutator segment gaps 321 and 322 in a manner that both ends of the lower extent of the deep slot 32 reach indents 1*b* of the segments 1 which form the gaps 321 and 322 there between. The base portion 21 of the resin body is retained uncut by slots 31, 32 in order to firmly secure the overriding segments 1 by embedding therein the lower end parts thereof and the risers thereof. The radially outer end tips of the risers 1*a* protrude out of the resin body to serve as terminals to which the ends of rotor coils are connected.

The segments disposed along a cylindrical face and the resin body 2 filled into the space defined centrally of the segments are cut with deep slots 31 and 32 which are parallel with the axis of the commutator and the commutator is characterized in that each deep slot is formed across a pair of opposing commutator segment gaps and reaches the notches at the lower end parts of the segments.

The above-mentioned commutator for a small-sized motor may be manufactured as follows:

Firstly, a metal tube or pipe 1 is provided with a specified number of risers 1*a* as tabs bent outwards at one end thereof and with the same number of notches 1*b* disposed in the lower end of the pipe between the risers 1*a*. A body of plastic resin is molded in such a manner that the resin fills the through-bore of the metal pipe 1 and also forms a base portion 21 with a larger diameter than that within the pipe bore, so that the lower end region of the metal pipe and base portions of the risers 1*a* are embedded in the base portion 21 of the resin body as it hardens.

Secondly, when the resin has set or otherwise has hardened the first deep slot 31 and the second deep slot 32 are cut, chordwise, along planes parallel to the axis of the pipe e.g. by a known metal saw or like (conventional) means. The slots 31 and 32 are formed in a manner that each of the deep slots 31, 32 creates and extends between a pair of opposing commutator segment gaps 311, 312 or 321, 322 and intersects the notches 1*b*, 1*b* at the lower end parts of the segments, so that the metal pipe 1 is cut into a specified number of segments, in the instance depicted four. The base portion 21 is not cut; the deep slots 31 and 32 do not reach down as far as the base part, in order that the base part remains integral and firmly supports the overriding parts, the lower end parts of the segments 1 and the base portions of the risers 1*a*.

Since the deep slots 31 and 32 are formed across a pair of opposite segment gaps, each one cutting trip of the cutting tool makes two segment gaps at the same time, contrasted with one slot by one advancing of the cutting tool in the conventional commutator, and therefore, the number of cutting steps and number of revolving of the work in cutting is decreased almost to one-half of that necessitated for the conventional-type commutator, thereby decreasing manufacturing cost and time.

Furthermore, since the cutting is accomplished from the top face (upper end face) of the commutator, a higher precision of angle division can be made more easily than for the conventional commutator, thereby assuring better commutating action.

Since the deep slots 31 and 32 are formed between a pair of opposite segment metal gaps and one end of the slots opens at the top face of the resin body, a centrifugal airflow is created in the slots 31 and 32 from the space 212 around the shaft towards the segment gaps and outward therefrom when the commutator revolves at a high speed in use. Accordingly, no dust or powder of the commutator segment metals and/or brushes fill or deposits in the segment gaps or in the slots.

It should now be apparent that the commutator for small-sized electric motor as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

We claim:

1. A method for providing a commutator structure for a small-sized electric motor, comprising:

(a) providing a metallic tube having a plurality of angularly spaced notches in one end thereof and providing a plurality of outwardly radiating metallic tabs on said metallic tube adjacent said one end thereof, one such tab being disposed angularly between each two angularly adjacent ones of said notches;

(b) providing the tube with a filling of plastic resin;

embedding said metallic tube axially beyond the bottoms of said notches in said filling of plastic resin and about the bases of said tabs, so that the distal ends of said tabs protrude out through said filling, as part of step (b);

(c) permitting the filling to harden into a molded-in-place generally cylindrical body of hardened plastic resin; and (d) cutting longitudinally through said tube from the opposite end thereof and body only twice, at such an angular disposition and axial extent as to intersect, with each such cut, two of said notches, but with insufficient axial extent as to cut the body in two, one such cut being made along a diametrical plane of said commutator structure and the other such cut intermediately intersecting said one such cut, at a site radially displaced from the longitudinal axis of said commutator structure along said diametrical plane.

2. The method of claim 1, further comprising:

providing said body with a longitudinal through-bore, securing a shaft in said through-bore axially beyond the depth of said cuts, and so situating said shaft that said shaft extends out at least one end of the through-bore and is radially spaced from said through-bore along the length of said cuts.

3. The method of claim 1, wherein:

said other such cut is made at right angles to said one such cut.

* * * * *